US007192027B2

(12) United States Patent
Schlough

(10) Patent No.: US 7,192,027 B2
(45) Date of Patent: Mar. 20, 2007

(54) SIGNATURE TRANSPORT DEVICE

(75) Inventor: James Richard Schlough, Stratham, NH (US)

(73) Assignee: Goss International Americas, Inc., Dover, NH (US)

( * ) Notice: Subject to any disclaimer, the term of this patent is extended or adjusted under 35 U.S.C. 154(b) by 162 days.

(21) Appl. No.: 10/819,864

(22) Filed: Apr. 7, 2004

(65) Prior Publication Data

US 2005/0225023 A1 Oct. 13, 2005

(51) Int. Cl.
*B65H 5/02* (2006.01)
*B65H 39/00* (2006.01)
*B65G 49/00* (2006.01)

(52) U.S. Cl. ..... 271/225; 271/69; 198/644; 270/52.14

(58) Field of Classification Search ..... 271/225, 271/264, 272, 306, 204, 205, 206, 69; 270/52.14, 270/52.19, 52.22, 52.26; 198/463.3, 629, 198/644, 861.3, 861.5
See application file for complete search history.

(56) References Cited

U.S. PATENT DOCUMENTS 4,022,455 A 5/1977 Newsome et al. ..... 270/54
4,260,145 A * 4/1981 Mebus et al. ..... 270/52.14
4,482,141 A 11/1984 Moser ..... 270/54
4,489,930 A * 12/1984 Meier ..... 270/52.3
4,519,599 A * 5/1985 Mayer ..... 270/52.18
6,003,859 A * 12/1999 Reist ..... 271/204
6,315,107 B1 * 11/2001 Muller et al. ..... 198/606
6,458,066 B1 10/2002 Breton et al. ..... 493/423
6,612,559 B2 * 9/2003 Boss ..... 270/52.18
6,616,139 B2 9/2003 Aesch ..... 271/204
6,789,793 B2 9/2004 Caunter et al. ..... 271/175

FOREIGN PATENT DOCUMENTS

CH 683767 5/1994
EP 0 771 675 A1 5/1997

* cited by examiner

*Primary Examiner*—Patrick Mackey
*Assistant Examiner*—Mark J. Beauchaine
(74) *Attorney, Agent, or Firm*—Davidson, Davidson & Kappel, LLC

(57) ABSTRACT

A signature transport device includes a first conveyor for moving a plurality of folded signatures in a first direction and a second conveyor including a first blade having a first edge for lifting a first signature of the plurality of signatures from the first conveyor. The first edge is parallel to the first direction, and the blade moves in a second direction sloping upward at an acute angle with respect to the first direction. In addition, a method for conveying signatures is disclosed.

18 Claims, 2 Drawing Sheets

SIGNATURE TRANSPORT DEVICE

BACKGROUND OF THE INVENTION

The present invention relates generally to binding machinery for a printing press and more particularly to a device for transporting printed products.

A saddle binder may collate signatures to assemble complete sets of signatures and bind them together using wire stitches. The signatures are opened to the center fold and collated by feeding mechanisms onto a saddle raceway to be conveyed past a stitching mechanism. These bound signatures, or books, are then removed from the saddle conveyor for further processing, such as trimming of the unbound edges.

U.S. Pat. No. 4,482,141, which is incorporated by reference herein, discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

European Patent Application No. 0771 675 A1, which is incorporated by reference herein, discloses a device for removing signatures from a saddle conveyor supporting the signatures. The conveyor has cutouts that permit the signatures to be gripped from above by a rotating clamping device, which then further conveys the signatures to a belt conveyor.

U.S. Pat. No. 6,616,139, which is incorporated by reference herein, discloses a device for removing signatures from a saddle conveyor that moves the signatures over cutouts in a sword. Grippers grip the outside of the signature from above and transfer the signatures to a further conveying device.

U.S. Pat. No. 6,789,793, which is incorporated by reference herein, discloses a device for transporting signatures that includes a conveyor for moving a plurality of signatures in a first direction. A rotary blade device having a first blade with an edge for lifting the first signature of the plurality of signatures from the conveyor.

Swiss Patent No. CH 68 37 67, which is incorporated by reference herein, discloses a method for supporting and handling printed products using saddle-shaped support members on an endless conveyor. Displacement members for displacing the support members may be lifted up by a centrally pivoted lever.

SUMMARY OF THE INVENTION

An object of the present invention is to permit efficient removal of signatures from a saddle conveyor.

The present invention provides a signature transport device comprising: a first conveyor for moving a plurality of folded signatures in a first direction, and a second conveyor including a first blade having a first edge parallel to the first direction for lifting a first signature of the plurality of signatures from the first conveyor. The first blade moves in a second direction sloping upward at an acute angle with respect to the first direction.

By moving the first blade in a second direction sloping upward with respect to the first direction, while the edge remains parallel to the first direction, the edge can lift the signatures from the conveyor. Because the second direction slopes upward with respect to the first direction at an acute angle, the lifting movement is gentle as compared with a movement perpendicular to the blade.

Preferably, each of the plurality of folded signatures is folded over a raceway of the first conveyor with a fold at the top of the raceway, and the first edge is configured to contact an underside of the fold of the first signature.

The acute is preferably between 5 and 30 degrees, and more preferably between 10 and 15 degrees.

The second conveyor may include a drive sprocket rotating around a drive axis, a second sprocket rotating around a second axis, and a chain supporting the first blade and circulating around the drive and second sprockets.

Preferably, a second blade supported by the chain has a second edge parallel to the first edge. The second blade is preferably longer than the first blade and the second edge is preferably aligned with the first edge so as to contact the first signature simultaneously with the first edge. The first and second blades act in a manner of a step of an escalator, so that the first signature may be lifted off or the first conveyor while being simultaneously supported by at least the first and second blades.

Preferably, the plurality of folded signatures move in the first direction at a first speed and the first blade moves in the second direction at a second speed, wherein the second speed having a speed vector component in the first direction, the speed vector component being at least as great as the first speed. Preferably the speed vector component is the same as, or slightly greater than the first speed. In addition, the first direction is typically horizontal or near horizontal The signature transport device may also include a gripper device having a first gripper for gripping exterior surfaces of the first signature. The gripper device is preferably a rotary gripper device. A tangential movement direction of the first gripper as it grips the first signature preferably corresponds to the second direction, and a speed of the first gripper corresponds to the second speed, so that there is little or no relative movement between the first gripper and the first signature as it grips the first signature.

The signature transport device may also include an idler arm supporting the second sprocket, the idler arm being pivotable about the drive axis so as to move the second sprocket from a working position to a lower position.

In addition, the present invention provides a signature transport device for lifting signatures from a saddle raceway that includes a first sprocket, a second sprocket, a chain circulating around the first and second sprocket, and a first blade moving with the chain. A portion of the chain moves from the first sprocket to the second sprocket in an upward sloping direction with respect to the raceway. The first blade has a first edge aligned parallel with the raceway and configured to contact a first signature from the raceway.

The first edge is preferably configured to lift the first signature from the saddle raceway so as to make the first signature available to a gripper device.

The present invention further provides a method for conveying folded signatures. The method includes: disposing a plurality of folded signatures in an inverted V-shaped orientation along a raceway, each of the folded signatures having a fold disposed above the first conveyor; conveying the plurality of folded signatures along the raceway in a first direction; moving a first blade of a second conveyor in a second direction, the second direction sloping upward at an acute angle with respect to the first direction; and contacting a first signature of the plurality of folded signatures underneath the fold with an edge of the first blade.

BRIEF DESCRIPTION OF THE DRAWINGS

The following figures show a preferred embodiment of the present invention in which.

DETAILED DESCRIPTION OF A PREFERRED EMBODIMENT

Figure 1:
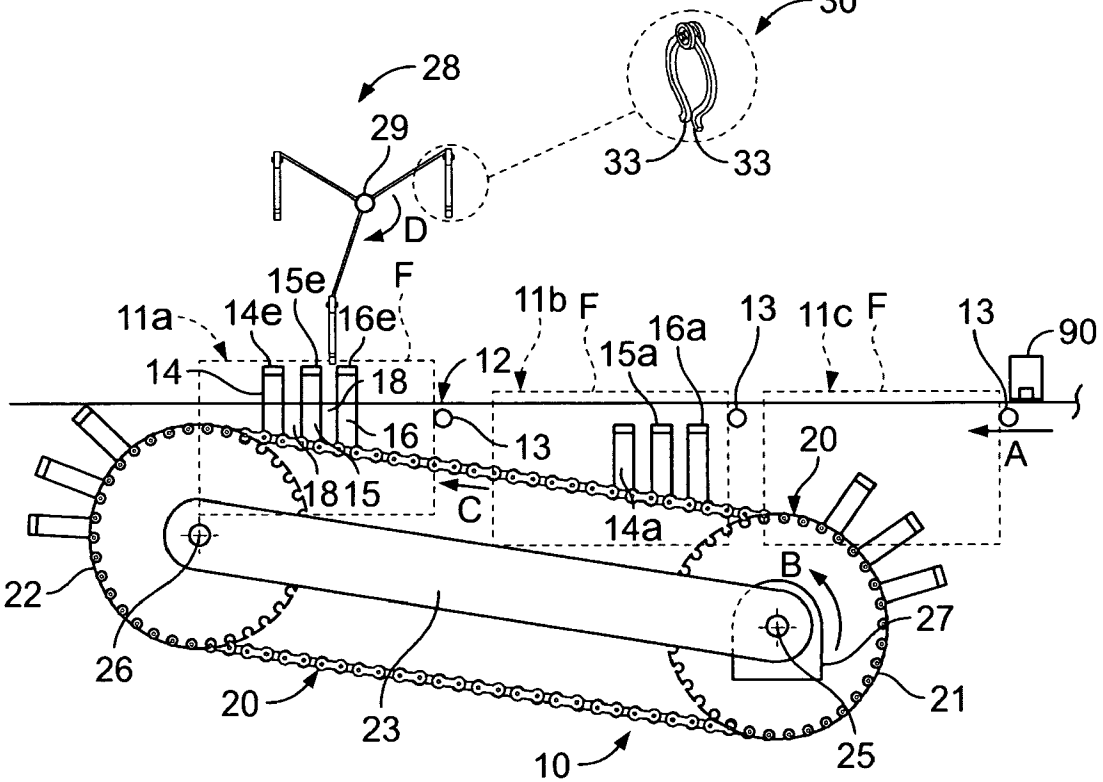
FIG. 1 shows a schematic side view of a preferred exemplary embodiment of a signature transport device of the present invention.

FIG. 1 shows a preferred exemplary embodiment of a saddle stitching binder having a signature transport device according to the present invention. The saddle binder has a collating unit that assembles signatures, which are opened to the center fold and collated by feeding mechanisms onto a saddle raceway 12.

Figure 2:
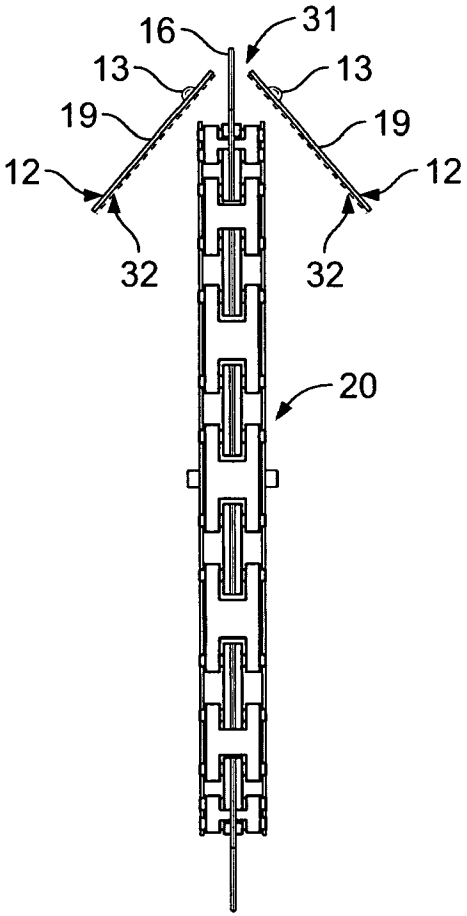
FIG. 2 shows a partial front view of the embodiment of FIG. 1.

The signatures are conveyed on the saddle raceway 12, in an inverted V-orientation with a fold F of the signature being on top of the saddle raceway 12, and the sides of the signature draped over guide sheets 32 of raceway 12. A stitcher 90 can stitch the fold F of the signature with a wire stitch. FIG. 2 shows a front view of a portion of the saddle raceway 12 and signature lifting device 10 including a portion of chain 20 and blade 16. Two transport belts 19, having transport pins 13 extending therefrom, move along the raceway 12 in the direction of arrow A, thereby conveying the signatures along raceway 12. There is a gap 31 between guide sheets 32 at the top of raceway 12, and the fold F of the signature is disposed above the gap 31.

The signatures may be lifted from the raceway 12 by a signature lifting device 10 passing between the belts 19 of the raceway 12, through gap 31, and lifting the signature from below the fold F.

The signature lifting device 10 includes a drive sprocket 21 being driven by a drive motor 27 around drive axis 25 in the direction of arrow B. Chain 20 circulates around drive sprocket 21 and around a second sprocket, which may be an idler sprocket 22, causing the second sprocket to rotate around axis 26 in the same direction as the drive sprocket 21. An idler arm 23 joins idler sprocket 22 to drive sprocket 21. Chain 20 supports a number of blades, including a first set of blades 14, 15, 16, and a second set of blades 14*a*, 15*a*, 16*a*. Each blade is supported by a link of the chain so as to extend rigidly outward from the chain as it circulates around sprockets 21 and 22 with the chain 20. The upper half of chain 20 and the blades attached thereto move in the direction of arrow C, which slopes upward from direction A at an acute angle of approximately 10 to 15 degrees.

Each of blades 14, 15, 16 includes an upper edge, 14*e*, 15*e*, 16*e*, that is aligned parallel to the raceway 12 and parallel to direction A. In addition, the length of each of the blades 14, 15, 16, differ from one another so that the corresponding edges 14*e*, 15*e*, 16*e* are aligned horizontally (i.e. are in-line with one another in the A-direction). Thus, as the blades 14, 15, 16 move together in direction C, the edges 14*e*, 15*e*, 16*e* contact the Fold F of signature 11*a* essentially simultaneously, and together lift the signature up from the raceway 12. The movement of each set of blades (e.g. 14, 15, 16) is thus similar to that of a step of an escalator, moving at an angle to the horizontal while maintaining a horizontal profile.

Preferably, the speed at which the chain 20 and blades 14, 15, 16 move around the sprockets and in the C-direction is selected such that a horizontal component of the blade speed is approximately equal to the speed of signatures 11*a*, 11*b*, 11*c* in the A-direction. More generally, (e.g., if direction A is not exactly horizontal), the blade speed in the C-direction has a component in the A-direction that is approximately equal to the speed of the signatures in the A-direction. By making those values approximately equal, there is little or no relative movement between the signature 11*a* and the blade edges 14*e*, 15*e*, 16*e* at the time that contact of the blades to the fold F is made. Alternatively, the A-direction component of the blade speed may be selected to be slightly greater than the signature speed. In this way, the signature is slightly accelerated forward of transport pin 13 as it is lifted, so as to avoid interference with the transport pin throughout the lifting and further handling of the signature.

Once signature 11*a* has been lifted on blade edges 14*e*, 15*e*, 16*e*, away from raceway 12, the signature may be gripped by rotary gripper device 28, and lifted from the blades. Rotary gripper device 28 has three grippers 30 at the end of three arms that rotate around axis 29 in the direction of arrow D. Grippers 30 maintain a similar orientation as they rotate so that the gripper fingers are aligned parallel to the fold F.

The gripper 30 is configured to clamp down in exterior sides of the signature and lift the signature from the blades 14*e*, 15*e*, 16*e*. Preferably, each gripper 30 includes two identical sides, each side having at least two fingers 33, 34, which clamp against each other in regions of the vertical gaps 18 between the blades. In that way, the gripper 30 can lift signature 11*a* with a minimum amount of friction or other interference from the blades.

The gripper device 28 and each gripper 30 rotates at a constant rotational speed in the D-direction. The gripper device is preferably configured so that each gripper 30 clamps down on (i.e. grips) each signature at the location along the circular path having a tangent in the C-direction. Moreover, the rotational speed of each gripper 30 may be selected so that a tangential component of the speed in the C-direction matches the blade speed in the C-direction, but may also be selected to be somewhat faster. If a matching speed is selected, a relative movement between the fingers 33 of gripper 30 and the signature 11*a* is zero, or close to zero, at the moment the signature is gripped. Once the signature 11*a* is gripped, it is lifted from the blades 14, 15, 16 as the gripper 30 continues along on its circular path. Grippers 30 are configured to unclamp (i.e. release) the signature when the tangential direction of the rotary movement is in the approximately vertically upward direction, and the signature is fed to a further process step. The clamping and unclamping of the grippers 30 may be accomplished in any known manner, such as by using cam followers running in cams, which are configured to open and close the grippers at the appropriate locations along the circular rotational path.

Idler sprocket 22 is supported by idler arm 23, which is pivotably attached at axis 25. In operation, idler arm 23 and idler sprocket 22 are in the position shown. In the case of a paper jam, idler arm 23 can be pivoted downward about axis 25 to allow for the jam to be cleared. A spring may be provided to for biasing the idler arm in the upper operating position, for example, against a stop.

Figure 3:
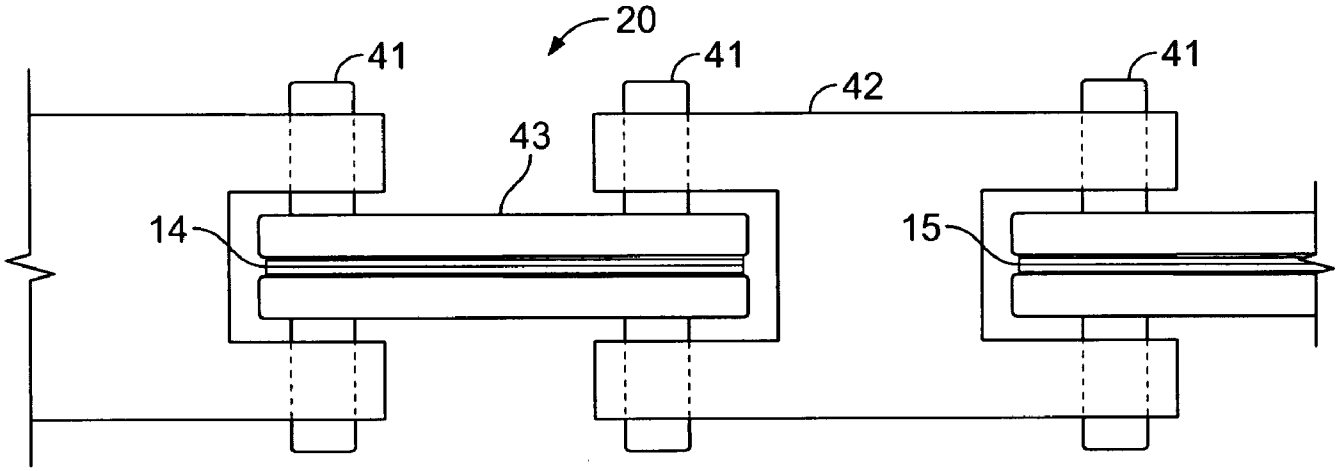
FIG. 3 shows a detail view of a chain from the FIG. 1 embodiment.

FIG. 3 shows a detail of one embodiment of chain 20. Dowel pins 41 are evenly spaced along chain 20 and connected to each other alternately by links 42 and blade supports 43. Blades (e.g. 14, 15, and 16) are each supported by blade supports 43. Links 42 and blade supports 43 may be made of a rigid and durable material such as metal or plastic. Dowel pins 41 connect links 42 and blade supports 43 in a rotatable manner. Alternatively, links 42 may be provided between every dowel pin 41, and blade support 43 may be attached to selected ones of the links 42.

Figure 4:
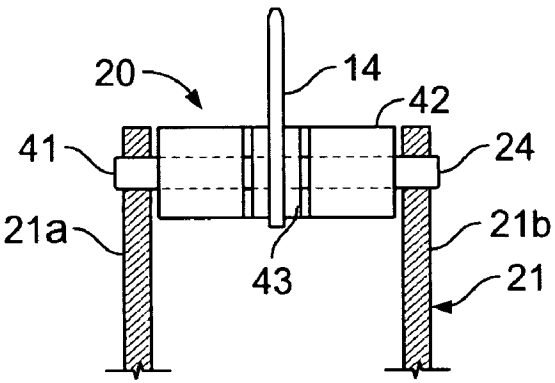
FIG. 4 shows a detail view of a chain and sprocket.

FIG. 4 shows a detail of chain 20 being supported by drive sprocket 21, which includes two identical sprocket wheels 21*a* and 21*b*. Each dowel pin 41 fits into a notch 24 of sprocket 21, so that the rotation of sprocket 21 drives chain 20 to rotate with the sprocket. Blade 14 is extending in the upward direction from blade support 43.

Figure 5:
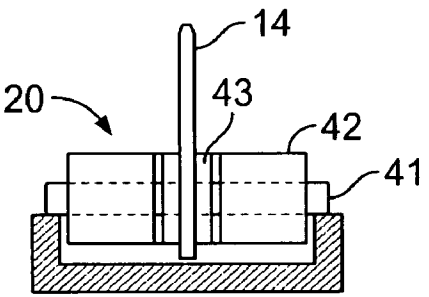
FIG. 5 shows detail view of an upper chain support.
Figure 6:
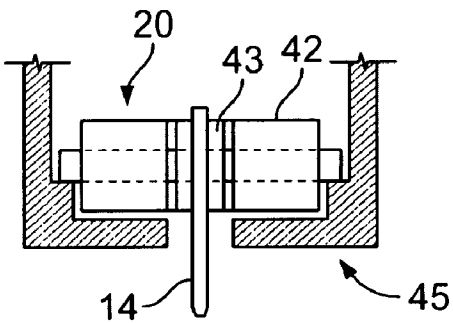
FIG. 6 shows a detail view of a lower chain support.

FIG. 5 shows a detail of a portion of chain 20 that is between sprockets 21 and 22 in the upper half of the chain. Upper chain support 44 may be disposed below chain 20 to provide vertical support to chain 20 to counteract a downward force on blade tip 14*e* of blade 14, such as that caused by signature 11*a*. FIG. 6 shows a detail of a portion of chain 20 that is between sprockets 21 and 22 in the lower half of the chain. Lower chain support 45 may be disposed below chain 20 and to provide vertical support to support chain 20 so as to prevent sagging. Lower chain support 45 includes a gap, through which downward projecting blade 14 may pass.

The term "signature", as defined herein, can include single sheet or multi-sheet printed product, which may also be referred to as a book, and may be stitched or unstitched.

What is claimed is:

1. A signature transport device comprising:

a first conveyor for moving a plurality of folded signatures in a first direction; and a second conveyor including a first blade having a first edge parallel to the first direction for lifting a first signature of the plurality of signatures from the first conveyor, the first blade moving in a second direction sloping upward at an acute angle with respect to the first direction, the first edge being angled with respect to the second direction;

the second conveyor including a drive sprocket rotating around a drive axis, a second sprocket rotating around a second axis, and a chain supporting the first blade and circulating around the drive and second sprockets.

2. The signature transport device as recited in claim 1 wherein each of the plurality of folded signatures is folded over a raceway of the first conveyor with a fold at the top of the raceway, and the first edge is configured to contact an underside of the fold of the first signature.

3. The signature transport device as recited in claim 1 wherein the acute angle is between 5 and 30 degrees.

4. The signature transport device as recited in claim 1 wherein the acute angle is between 10 and 15 degrees.

5. The signature transport device as recited in claim 1 wherein the second conveyor includes a second blade supported by the chain, the second blade having a second edge parallel to the first edge.

6. The signature transport device as recited in claim 5 wherein the second blade is longer than the first blade and the second edge is aligned with the first edge so as to contact the first signature simultaneously with the first edge.

7. The signature transport device as recited in claim 1 wherein the plurality of folded signatures move in the first direction at a first speed, and wherein the first blade moves in the second direction at a second speed, the second speed having a speed vector component in the first direction, the speed vector component being at least as great as the first speed.

8. The signature transport device as recited in claim 7 wherein the speed vector component is equal to the first speed.

9. The signature transport device as recited in claim 1 further comprising a gripper device having a first gripper for gripping exterior surfaces of the first signature.

10. The signature transport device as recited in claim 9 wherein the gripper device is a rotary gripper device, and wherein a tangential movement direction of the first gripper as it grips the first signature corresponds to the second direction.

11. The signature transport device as recited in claim 7 further comprising a gripper device having a first gripper, and wherein a speed of the first gripper corresponds to the second speed.

12. The signature transport device as recited in claim 1, further comprising an idler arm supporting the second sprocket, the idler arm being pivotable about the drive axis so as to move the second sprocket from a working position to a lower position.

13. A saddle stitching binder comprising the signature transport device as recited in claim 1.

14. A saddle stitching binder comprising:

a saddle raceway; and a signature transport device for lifting signatures from the saddle raceway, the signature transport device including:

a first sprocket;

a second sprocket;

a chain circulating around the first and second sprocket, wherein a portion of the chain moves from the first sprocket to the second sprocket in an upward sloping direction with respect to the raceway; and a first blade moving with the chain and having a first edge aligned parallel with the raceway and angled with respect to the chain and configured to contact a first signature from the raceway.

15. The saddle stitching binder as recited in claim 14, wherein the first blade is configured to lift the first signature from the raceway so as to make the first signature available to a gripper device.

16. A method for conveying folded signatures, the method comprising:

disposing a plurality of folded signatures in an inverted V-shaped orientation along a raceway, each of the folded signatures having a fold disposed above the raceway;

conveying the plurality of folded signatures along the raceway in a first direction;

moving a first blade and a second blade of a conveyor in a second direction, the second direction sloping upward at an acute angle with respect to the first direction;

contacting a first signature of the plurality of folded signatures underneath the fold with an edge of the first blade; and contacting the first signature underneath the fold with a second edge of the second blade, the second blade being longer than the first blade.

17. A signature transport device comprising:

a first conveyor for moving a plurality of folded signatures in a first direction; and a second conveyor including a first blade having a first edge parallel to the first direction for lifting a first signature of the plurality of signatures from the first conveyor, the first blade moving in a second direction sloping upward at an acute angle with respect to the first direction;

the second conveyor including a second blade supported by the chain, the second blade having a second edge parallel to the first edge, the second blade being longer than the first blade and the second edge being aligned with the first edge so as to contact the first signature simultaneously with the first edge.

18. A signature transport device comprising:

a first conveyor for moving a plurality of folded signatures in a first direction; and a second conveyor including a first blade having a first edge parallel to the first direction for lifting a first signature of the plurality of signatures from the first conveyor, the first blade moving in a second direction sloping upward at an acute angle with respect to the first direction;

the second conveyor including a drive sprocket rotating around a drive axis, a second sprocket rotating around a second axis, a chain supporting the first blade and circulating around the drive and second sprockets, and an idler arm supporting the second sprocket, the idler arm being pivotable about the drive axis so as to move the second sprocket from a working position to a lower position.

* * * * *